US006348510B1

(12) United States Patent
Maretto et al.

(10) Patent No.: US 6,348,510 B1
(45) Date of Patent: Feb. 19, 2002

(54) FISCHER-TROPSCH PROCESS

(75) Inventors: Cristina Maretto, Padua; Vincenzo Piccolo, Paullo, both of (IT); Jean-Christophe Viguie, St. Symphorien d'Ozon; Gilles Ferschneider, Chaponnay, both of (FR)

(73) Assignees: ENI S.p.A.; AGIP Petroli S.p.A., both of Rome (IT); Institut Francais du Petrole, Rueil-Malmaison (FR); Enitecnologie S.p.A., San Donato Milanese (IT)

( * ) Notice: Subject to any disclaimer, the term of this patent is extended or adjusted under 35 U.S.C. 154(b) by 0 days.

(21) Appl. No.: 09/595,031

(22) Filed: Jun. 16, 2000

(30) Foreign Application Priority Data

Jun. 17, 1999 (IT) ..... MI99A1348

(51) Int. Cl.[7] ..... C07C 27/00
(52) U.S. Cl. ..... 518/715; 518/700
(58) Field of Search ..... 518/700, 715

(56) References Cited

U.S. PATENT DOCUMENTS 5,348,982 A * 9/1994 Herbolzheimer et al. ... 518/700
5,827,902 A 10/1998 Maretto et al.

FOREIGN PATENT DOCUMENTS

EP 0 450 860 10/1991

* cited by examiner

*Primary Examiner*—Johann Richter
*Assistant Examiner*—J. Parsa
(74) *Attorney, Agent, or Firm*—Oblon, Spivak, McClelland, Maier & Neustadt, P.C.

(57) ABSTRACT

Optimized process for effecting the production of heavy hydrocarbons according to the Fischer-Tropsch method which comprises:

(a) feeding the reagent gases into a reactor;

(b) at least partially recovering the heavy hydrocarbons formed in step (a) by their external or internal separation from the catalytic particles;

the above process being characterized in that in step (a) the reaction takes place:

(1) in t he presence of solid particles which have a particle Reynolds number ($Re_p$) greater than 0.1, (2) keeping the solid particles suspended at a height H, with $U_s$, $U_l$, and $U_g$ value s which are such as to have a Bodenstein number $Bo_s \leqq 1$, preferably $\leqq 0.4$.

8 Claims, 7 Drawing Sheets

(W. LEUNG)

(W. LEUNG)

FISCHER-TROPSCH PROCESS

The present invention relates to an improved process for the Fischer-Tropsch reaction, which essentially consists in a first reaction phase in a gas-liquid-solid fluidized reactor and a second separation phase, at least partial, internal or external, of the solid suspension in the liquid.

The Fischer-Tropsch reaction consists in the production of essentially linear and saturated hydrocarbons, preferably having at least 5 carbon atoms in the molecule, by means of the catalytic hydrogenation of CO, optionally diluted with $CO_2$.

The reaction between CO and $H_2$ is carried out in a gas-liquid-solid fluidized reactor in which the solid, prevalently consisting of particles of catalyst, is suspended by means of the gas stream and liquid stream. The former prevalently consists of reagent species, i.e. CO and $H_2$, whereas the latter consists of hydrocarbons produced by the Fischer-Tropsch reaction, optionally at least partially recycled, either from the material liquid under the process conditions, or the relative mixtures.

The gas and liquid, optionally recycled, are fed from the bottom of the column by means of appropriate distributors and the flow-rates of the gas and liquid are such as to guarantee a turbulent flow regime in the column.

In gas-liquid-solid fluidized systems such as that of the Fischer-Tropsch reaction, the flow-rates of the fluids should be such as to guarantee a practically homogeneous suspension of the solid in the whole reaction volume and facilitate the removal of the heat produced by the exothermic reaction, improving the heat exchange between the reaction zone and a suitable exchanger device inserted in the column.

In addition, the solid particles should have dimensions which are sufficiently large as to enable them to be easily separated from the liquid products, but sufficiently small as to render the diffusive intra-particle limitations negligible (unitary particle efficiency) and enable them to be easily fluidized.

The average diameter of the solid particles used in slurry reactors can vary from 1 to 200 $\mu$m, although operating with dimensions of less than 10 $\mu$m makes the separation of the solid from the liquid products extremely expensive.

In the Fischer-Tropsch process, as in all three-phase processes in the presence of catalysts, there is therefore the problem of an optimum particle dimension in both the reaction and separation steps.

As far as the fluidization of the solid particles is concerned, EP-A-450,860 discloses operating in reaction phase with a slurry bubble column under optimum conditions when the following equation is respected:

$$0.5\ (U_s - U_l) \leq D/H \tag{1}$$

wherein $U_l$ is the circulation velocity of the liquid phase, D is the axial dispersion coefficient of the solid phase, H is the dispersion height (gas+liquid+solid) and $U_s$ is the settling velocity of the particles defined as follows:

$$U_s = \frac{1}{18} \cdot d_p^2 \frac{\rho_s - \rho_l}{\mu_L} \cdot g \cdot f(C_p) \tag{2}$$

wherein $d_p$ is the average particle diameter, $\rho_s$ is the density of the solid, $\rho_l$ is the density of the liquid, $\mu$ the viscosity of the liquid, g the gravity acceleration and $f(C_p)$ represents the hindering function due to the presence of other particles and depending on the volumetric concentration of the particles $C_p$.

The description of EP'860, however, is very incomplete and discloses, moreover, the use of particles with very small dimensions, with obvious limits in the solid-liquid separation step. In other words, the technical problem of EP'860 relates only to the reaction phase and not to the whole process, comprising both the reaction and solid-liquid separation.

Above all, EP'860 does not indicate any method or correlation for determining the axial dispersion coefficient of the solid, D (a fundamental parameter in verifying the constraint (1)), neither does it provide any experimental values of D for comparison. In addition, if one succeeds in obtaining a value of D, assuming a dispersion height $H=2D/(U_s-U_l)$ (a value which is at the limit of the validity range of (1)), the concentration of the solid proves to decrease from the bottom to the top of the reaction volume by a factor of 7.4. If this height is halved, the reduction factor of the concentration of the solid decreases to 2.4 which however is very high. As mentioned above, on the other hand, an optimum condition for a slurry reactor should comprise a uniform concentration profile in the whole catalyst volume.

EP-A-450,860 also discloses operating according to Stokes' law: it is in fact known in literature that the term, $$\frac{1}{18} \cdot d_p^2 \frac{\rho_s - \rho_l}{\mu_L} \cdot g,$$

introduced in the definition of $U_s$ of equation (2), represents the terminal settling velocity of the particle, $U_t$, according to Stokes' law. This law (see Perry's Chemical Engineers' Handbook, $6^{th}$ Ed.) is valid in the laminar regime when the Reynolds' particle number $Re_p$ is less than 0.1. As the Reynolds' number is a function of the properties of the liquid-solid system and of the particle dimensions, once the liquid phase (Fischer-Tropsch synthesis waxes) and type of solid (catalyst for Fischer-Tropsch synthesis, for example Cobalt supported on alumina) have been established, there is a higher limit for the average particle diameter, over which Stokes' law is no longer valid.

As a result EP'860 discloses operating with particle dimensions of over 5 $\mu$m, but not exceeding the limit value of $d_p$ established by Stokes' law.

For example, considering the data provided in EP'860 for a system consisting of Fischer-Tropsch waxes and Cobalt supported on Titania ($\rho_l$=0.7 g/cm$^3$, $\rho_s$=2.7 g/cm$^3$, $\mu$=1 cP), for Stokes' law to be valid, i.e. $Re_p<0.1$, the average particle diameter must be less than 51 $\mu$m (see example 1 of EP'860 for further details).

As is well known to experts in the field, this particle diameter, although excellent for the bubble column in reaction phase, creates drawbacks in the catalyst/liquid separation phase.

A method has now been found for effecting the Fischer-Tropsch process which overcomes the above disadvantages as it allows an optimized operation both in the reaction phase and in the solid-liquid separation phase, without substantially varying the activity of the catalyst.

In accordance with this, the present invention relates to an optimized method for the production of heavy hydrocarbons according to the Fischer-Tropsch process and the relative separation of the above hydrocarbons, starting from mixtures of reagent gases, essentially consisting of CO and $H_2$, optionally diluted with $CO_2$, in the presence of supported catalysts, which comprises:

(a) feeding the reagent gases into a reactor, preferably from the bottom, so as to obtain a good dispersion of the solid in the liquid phase, in this way at least partially transforming the reagent gases into heavy hydrocarbons, the gas flow-rates being such as to operate under heterogeneous or churn-turbulent flow conditions (i.e. in the presence of a wide size distribution of the bubbles of gas in the column, normally from about 3 mm to about 80 mm);

(b) at least partially recovering the heavy hydrocarbons formed in step (a) by their external or internal separation from the catalytic particles;

the above process being characterized in that in step (a) the reaction takes place:

(1) in the presence of solid particles so that the particle Reynolds' number ($Re_p$) is greater than 0.1, preferably from 0.11 to 50, even more preferably from 0.2 to 25, wherein $$Re_p = \frac{d_p \cdot v \cdot \rho_l}{\mu}$$

wherein $d_p$ is the average particle diameter, v is the relative velocity between particle and liquid, $\rho_l$ is the density of the liquid, $\mu$ is the viscosity of the liquid;

(2) maintaining the solid particles suspended at a height H, with such $U_s$, $U_l$ and $U_g$ values as to have a Bodenstein number $Bo_s \leqq 1$, preferably $\leqq 0.4$.

The Bodenstein number ($Bo_s$) is defined as $Bo_s = Pe_s (U_s - U_l)/U_g$, wherein $Pe_s$ is the Peclet number of the solid, $U_s$ is the sedimentation rate of the solid, $U_l$ is the circulation velocity of the liquid phase, $U_g$ is the superficial gas velocity. The Peclet number of the solid ($Pe_s$) is defined as $Pe_s = U_g.H/D_{ax,s}$, wherein H is the height of the dispersion (liquid+solid+gas) and $D_{ax,s}$, is the axial dispersion coefficient of the solid phase.

The catalysts used in the process of the present invention generally comprise metals of Group VIII, such as Iron, Cobalt, Ruthenium or relative mixtures on carriers of inorganic oxides. The above catalysts may contain additional promoters comprising metals selected from those of Group I, Group II, Group V, Group VII, alone or in mixtures.

The preferred catalysts which can be used in the process of the present invention comprise cobalt, optionally containing promoters, supported on inorganic oxides of at least one of the elements selected from Si, Ti, Al, Zn, Sn, Mg, Th. As far as the surface area of the carrier is concerned, this is within the range of 20–300 $m^2/g$, preferably 50–200 $m^2/g$ (BET).

When promoters are contained, these are present in such a quantity as to have a weight ratio between promoter and cobalt of 0.01/1 to 1/1, preferably from 0.025/1 to 0.1/1. When the catalyst contains cobalt, it is present in a quantity ranging from 2 to 50% by weight, preferably from 5 to 20% by weight.

The catalysts which can be used in the process of the present invention can be prepared with the known techniques, for examples by means of gelation, cogelation, impregnation, precipitation, dry impregnation, co-precipitation or mechanical mixing. In the preferred embodiment, the cobalt and optional promoters are linked to the carrier by putting the carrier itself in contact with a solution of a compound containing cobalt (or other possible promoters) by means of impregnation. Optionally the cobalt and possible promoters can be co-impregnated on the carrier itself. The compounds of Cobalt and optional promoters used in the impregnation can consist of any organic or inorganic metal compound susceptible to decomposing after heating in nitrogen, argon, helium or another inert gas, calcination in a gas containing oxygen, or treatment with hydrogen, at high temperatures, to give the corresponding metal, metal oxide, or mixtures of the metal or metal oxide phases.

Compounds of Cobalt (and possible promoters) can be used, such as nitrate, acetate, acetylacetonate, carbonyl naphthenate and the like. The quantity of impregnation solution should be sufficient to completely wet the carrier, usually within a range of about 1 to 20 times the carrier by volume, depending on the concentration of metal (or metals) in the impregnation solution.

The impregnation treatment can be carried out within a wide range of temperature conditions. After impregnation, the catalyst is dried by heating to a temperature of over 30° C., preferably from 30° C. to 125° C., in the presence of nitrogen or oxygen, or both or air, in a gas stream or under partial vacuum. The catalyst particle distribution is obtained within the desired dimensional range by the use of preformed carriers or with the usual techniques such as crushing, ultrasonic treatment or other procedures. Finally, the catalyst particles, are treated to obtain the desired dimensions using known techniques such as, for example, sieving.

The liquid phase necessary for fluidizing the catalyst can be any substance liquid under the reaction pressure and temperature conditions, capable of maintaining the catalyst under suspension, relatively inert under the reaction conditions, and of being a good solvent for carbon monoxide and hydrogen. Typical examples of organic liquids which can be used in the present process are paraffins, olefins, aromatic hydrocarbons, ethers, amines and relative mixtures, provided they are high-boiling. High-boiling paraffins comprise $C_{10}$–$C_{50}$ linear or branched paraffins; high-boiling olefins comprise liquid polyalpha-olefins; high-boiling aromatic hydrocarbons comprise single, multiple or condensed ring aromatic hydrocarbons. The preferred liquid hydrocarbon solvent is octacosane or hexadecane; n-paraffinic wax, i.e. the Fischer-Tropsch reaction product, is even more preferable.

The reaction conditions for the Fischer-Tropsch process are generally known to experts in the field. The temperature normally ranges from 160° C. to 360° C., preferably from 190° C. to 230° C., even more preferably from 190 to 220° C. The pressures are usually higher than 6 bars, preferably from 6 to 60 bars, more preferably from 10 to 30 bars. With an increase in temperature, the conversion of CO and selectivity to methane generally increase, whereas the stability of the catalyst decreases. Consequently, with an increase in the CO conversion due to the temperature, the yield to the desired products, i.e. $C_{5+}$, preferably $C_{10+}$, may not increase.

The ratios between carbon monoxide and hydrogen can vary within a wide range. Although the stoichiometric ratio $H_2/CO$ in the Fischer-Tropsch process is 2.1/1, in most cases a lower $H_2/CO$ ratio is used. For example, U.S. Pat. No. 4,681,867 describes preferred $H_2/CO$ ratios ranging from 1/2 to 1/1.4. In any case the process of the present invention is not limited to low $H_2/CO$ ratios. In fact, $H_2/CO$ ratios ranging from about 1.5/1 to about 2.5/1, preferably from about 1.2/1 to about 2.2/1, can be used.

In the reaction zone of the present invention, the catalyst is suspended and mixed prevalently by the movement induced by the bubbles of gas which rise along the column.

The present invention refers to a gas-liquid-solid system in which the gas flow-rate is such as to have a turbulent flow regime, characterized by a wide distribution of the bubble diameters (3–80 mm approx.) which rise through the column. The mixing and distribution of the catalyst inside the bubble column reactor prevalently derives from the fraction of gas which runs through the column in the form of large bubbles (about 20–80 mm), and drags in its upward motion, at a rising rate of the large bubbles in the order of 1–2 m/s approximately, both the liquid and solid suspended in the liquid. The gas therefore causes macro-vortexes of the continuous phase (liquid) in which the solid is suspended, increasing the dispersion degree of the solid and consequently the uniformity of the axial concentration profile of the solid, with respect to operating in a homogeneous flow regime (low gas flow-rates, gas bubbles uniformly distributed and with small dimensions, 3–6 mm).

We would like to point out that the process of the present invention comprises operating, in the reaction step (a), with a Reynolds' number of the catalytic particle $Re_p>0.1$, preferably from 0.11 to 50.

As will be explained further on in the examples, the Reynolds' number ($Re_p$) is a function of the density and viscosity of the liquid phase and also of the density of the catalyst particle and its dimensions. When waxes of the Fischer-Tropsch process are used as reaction liquid (therefore establishing the properties of the liquid phase under the reaction conditions), the Reynolds' number may only vary in relation to the density and dimensions of the catalytic particles. The expert in the field who knows the density of the catalytic particles he intends to use (normally similar to the density of the inert carrier material), can obtain the average diameter of particles which are such as to have a Reynolds' number greater than 0.1, preferably from 0.11 to 50, even more preferably from 0.2 to 25.

As far as the effect of the particle diameter on the catalyst activity is concerned, it is known from literature (Iglesia et al., *Computer Aided Design of Catalysts*, Ed. Becker-Pereira, 1993) that, for supported cobalt based catalysts for the Fischer-Tropsch synthesis, when operating with particles having dimensions of less than 200 μm, there are no substantial reductions in the catalytic performances due to intra-particle diffusion phenomena.

Step (b) of the process of the present invention comprises recovering, at least partially, the liquid products generated by the Fischer-Tropsch reaction by means of extraction from the reaction zone of a certain amount of slurry (liquid+solid). The separation of the desired quantity of liquid products is effected using equipment such as for example hydrocyclones or filters (tangential or frontal) or, preferably, static decanters. The separation step also generates a more concentrated slurry which can be recycled directly to the Fischer-Tropsch reactor, or it can be treated in a regeneration step of the catalyst or it can be partially removed to introduce fresh catalyst. The whole extraction process of the slurry for the separation of the liquid products and reintegration of the more concentrated slurry, partially regenerated and/or substituted, is regulated so as to keep the reaction volume and average concentration of the catalyst constant.

In the case of liquid-solid separation inside the reaction zone, it is possible to use filtration devices (for example cartridge filters) completely immersed in the slurry (liquid+solid) under reaction. When operating under turbulent flow regime conditions, the high rate of the phases (gas, liquid, solid) that lap against the filters, prevents or minimizes the formation of the solid panel, thus reducing interventions for maintenance and regeneration of the filtrating surface.

It should be pointed out that step (b) of the process of the present invention is carried out under favourable conditions. It is known, in fact, that for a certain flow-rate of slurry (liquid+solid), with an increase in the particle diameter, not only are the volumes of the separation section reduced, but the type of equipment necessary for separating the liquid products from the concentrated slurry is simplified. When particles having an average diameter of 150 μm rather than 5 μm are adopted, and with the use of hydrocyclones as separation devices, the unit number is drastically reduced; at the same time the dimensions of the single unit can be increased, thus facilitating the construction of the hydrocyclones themselves (see example 8 for further details) For particles having an average diameter higher than 100–150 μm it is possible to substitute the hydrocyclones with static separators (decanters), making the separation step easier and less expensive.

The process of the present invention is characterized in that it is effected not only within a certain Reynolds' number range, but also under such conditions as to have a reasonably uniform concentration profile of the solid, $C_p$ (x), along the reaction column; for example a profile $C_p$ (x) which varies by a maximum value of ±20% with respect to the average concentration value of the solid (catalyst), $\overline{C}_p$. This is equivalent to having a Bodenstein number ($Bo_s$) less than or equal to 0.4.

The concentration profile of the solid with respect to the axial co-ordinate of the bubble column reactor, is thus expressed as a function of the Bodenstein number, $Bo_s$, which among other parameters, is a function of the diameter of the column. As the diameter of the column increases, maintaining the other parameters constant, the mixing degree of the solid increases, thus improving the distribution of the catalyst inside the reactor. On the basis of the correlations indicated in the following examples, it is possible to determine the minimum diameter of the column sufficient to respect the constraint set for obtaining an optimum distribution of the solid. The value of this diameter is also a function of the solid particle dimensions. With an increase in the average diameter of the particles, the minimum diameter of the column increases: it is therefore possible to obtain an excellent dispersion of the solid phase by suitably dimensioning the reactor.

BRIEF DESCRIPTION OF THE DRAWINGS

With respect to the figure.

Figure 1:
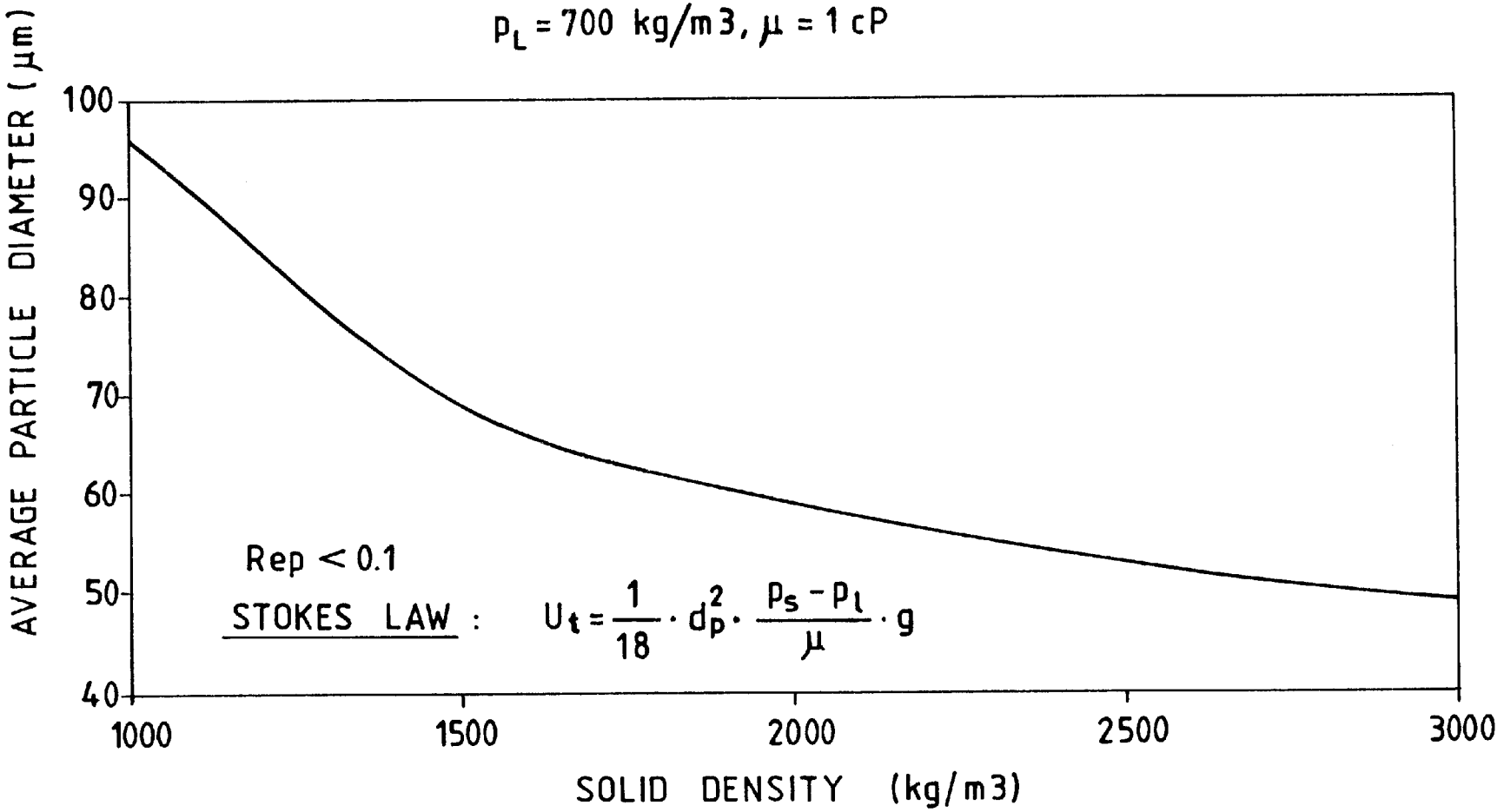
FIG. 1 represents the trend of the average diameter of the particles of solid catalyst in relation to the density of the above solid for a given liquid phase, discriminating the validity zone of Stokes' law ($Re_p<0.1$).

The following examples provide a better understanding of the present invention.

EXAMPLE 1

Determination of the Maximum Particle Diameter Value According to the Disclosures Contained in the Patent EP' 860

The patent EP'860 describes a method for optimizing the operating conditions of a slurry bubble column, in which the dimensions of the solid particles to be introduced into the column must be greater than 5 $\mu$m. In addition the settling velocity of the solid is defined according to the law:

$$U_s = \frac{1}{18} \cdot d_p^2 \frac{\rho_s - \rho_l}{\mu} \cdot g \cdot f(C_p) \quad \text{(E.1)}$$

The above formula for $U_s$ mainly consists of two terms:

$$-\frac{1}{18} \cdot d_p^2 \frac{\rho_s - \rho_l}{\mu} g$$

which represents the terminal settling velocity of the solid, $U_t$, expressed by means of Stokes' law;

$f(C_p)$ which represents the hindering effect due to the presence of other particles, i.e. to the concentration of the solid, and which is practically equal to 1 for extremely dilute slurry systems (liquid-solid), and tends towards 0 for very concentrated slurry systems (maximum packing).

It is known (*Perry's Chemical Engineers' Handbook*, $6^{th}$ *Ed*,) that Stokes' law is valid and applicable within a certain Reynolds' particle number range, precisely $Re_p$<=0.1, wherein $$Re_p = \frac{d_p \cdot v \cdot \rho_l}{\mu},$$

and wherein v is the relative velocity between particle and liquid; if the liquid is under batch conditions, then $v=U_t$.

Defining the settling velocity $U_s$ according to the equation (E.1), EP'860 discloses operating with a system wherein Stokes' law is valid.

In example 8 of EP'860 $U_s$ is determined for a liquid-solid system in which the solid consists of a catalyst Co/Re on Titania and the liquid consists of waxes. In this example it is affirmed that the Reynolds' particle number is "small" and $U_s$ can therefore be determined by Stokes' law multiplied by the function $f(C_p)$.

Example 8 of EP'860 gives the properties of the solid and liquid useful for determining $U_s$, which are:

density of the wax, $\rho_1$ =0.7 g/cm$^3$, viscosity of the wax, $\mu$=0.01 gr/cm/sec density of the catalyst particle, $p_s$=2.7 g/cm$^3$.

Using these data it turns out that $Re_p$<0.1 when $d_p$<51 $\mu$m.

This means that when operating with a system similar to that described in example 8 of EP'860, in order to be able to respect the condition (E.1), i.e. Stokes' law, contained in the main claim of the patent, it is necessary to use average particle dimensions of less than 51 $\mu$m, i.e. 5 $\mu$m<$d_p$<51 $\mu$m.

EXAMPLE 2

Determination of the Maximum Particle Diameter Value With Variations in the Properties of the Liquid-solid System so that Stokes' Law is Valid.

In example 1 the limit value of particle diameter $d_p$ was determined, in order to respect Stokes' law, in the case of the catalyst/waxes system described in example 8 of EP'860.

Using catalyst particles of different densities, the limit value of $d_p$ changes, i.e. with an increase in the density of the particle, the average particle dimension at which $Re_p$ is less than 0.1, decreases.

FIG. 1 shows the effect of the particle density on the limit value of $d_p$ so that Stokes' law is valid, when the properties of the liquid are the same as those described in example 1, whereas $p_s$ varies from 1 to 3 g/cm$^3$. The curve indicated in FIG. 1 represents the values of $d_p$ whereby $Re_p$=0.1; in addition the curve separates the graph $d_p$ vs. $\rho_s$ in two regions: in the region below the curve, Stokes' law is valid ($Re_p$<0.1), whereas in the upper region $Re_p$>0.1, and therefore Stokes' law is no longer valid.

For example, if the slurry column reactor is operating with solid particles having a density equal to 1.9 g/cm$^3$, the average solid particle dimensions must remain below 60 $\mu$m to make Stokes' law applicable. In this case, to operate within the scope of the patent Exxon EP' 860, it is necessary to have 5 $\mu$m<$d_p$<60 $\mu$m.

If the liquid has different properties from those indicated in EP'860, for example if $\mu$=0.005 gr/cm/sec then in order to have $Re_p$<0.1, the particles must have average dimensions $d_p$<38 $\mu$m.

As can be noted, not only the density of the solid, but also the viscosity of the liquid (which depends on the reaction conditions considered) influences the limit of $d_p$ to allow Stokes' law to be respected: on reducing the viscosity of the liquid, the limit value of $d_p$ decreases.

EXAMPLE 3

Determination of the Terminal Settling Velocity of the Solid Particles.

The terminal settling velocity of particle, $U_t$, is generally defined as follows (*Perry's Chemical Engineers' Handbook*, $6^{th}$ Ed.

$$U_t = \sqrt{\frac{2gm_p(\rho_s - \rho_l)}{\rho_l \rho_s A_p C}} \quad \text{(E.2)}$$

Assuming we are operating with particles having a prevalently spherical shape, Eq. (E.2) is transformed as follows:

$$U_t = \sqrt{\frac{4gd_p(\rho_s - \rho_l)}{3\rho_l C}} \quad \text{(E.3)}$$

The drag coefficient C which appears in Eq. (E.3) is a function of the Reynolds' particle number, $Re_p$. If $Re_p$ is less than 0.1 then $C=24/Re_p$ and the Eq. (E.3) becomes:

$$U_t = \frac{1}{18} \cdot d_p^2 \rho_s - \frac{\rho_l}{\mu} \cdot g \quad \text{(E.4)}$$

which corresponds to the terminal settling velocity rate according to Stokes' law.

For values of $Re_p$ higher than 0.1, the relation between C and $Re_p$ changes (Perry's):

when 0.1<$Re_p$<1000(intermediate region):

$C=(24/Re_p)\cdot(1+0.14\cdot Re_p^{0.7})$;

when 1000<$Re_p$<350000 (Newton region) : C≅0.445;

when $Re_p>10^6$: $C=0.19-(8\cdot 10^4/Re_p)$

Considering for example the case of operating with a slurry bubble column reactor in intermediate regime ($0.1<Re_p<1000$), and wishing to determine the terminal settling velocity value, $U_t$, as $Re_p$ is a function of $U_t$, it is not possible to know "a priori" the value of $Re_p$ to calculate C, and consequently of $U_t$ according to the Eq. (E.3).

By substituting the formula for the resistance coefficient $C=(24/Re_p)\cdot(1+0.14\cdot Re_p^{0.7})$, relating to the regime considered, in the Eq. (E.3), an implicit function of $U_t$ is obtained:

$$U_t=\sqrt{\frac{g\cdot d_p\cdot(\rho_s-\rho_l)\cdot Re_p}{18\cdot\rho_l\cdot(1+0.14\cdot Re_p^{0.7})}} \quad \text{(E.5)}$$

which can be numerically resolved, by knowing the properties of the liquid-solid system and the average particle dimension.

Figure 2:
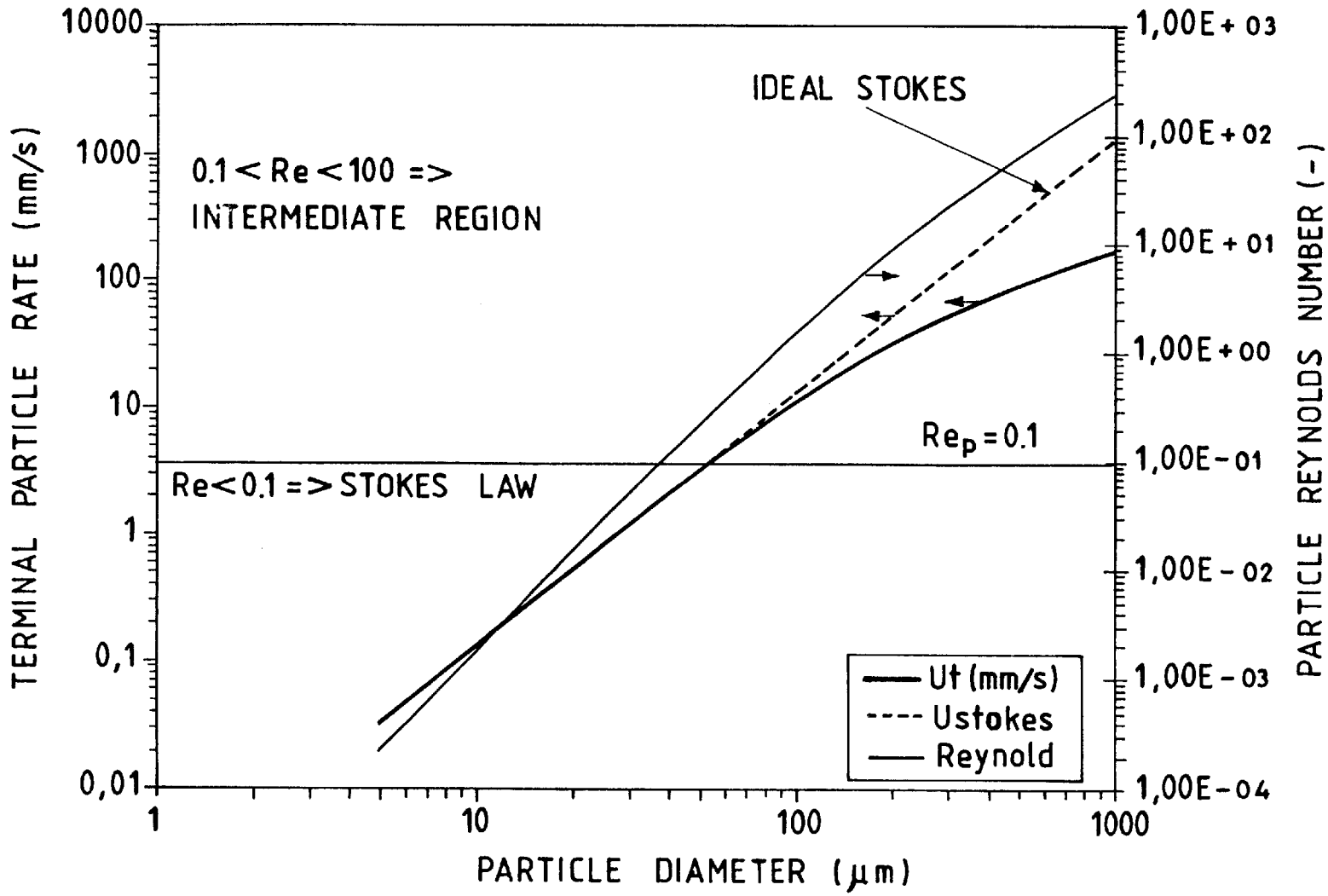
FIG. 2 represents the trend of $U_t$ (terminal settling velocity of the solid) and $Re_p$ as a function of $d_p$ (average diameter of the solid) for the liquid-solid system of example 3, discriminating the validity zone of Stokes' law.

FIG. 2 indicates the value of $U_t$ as a function of $d_p$ (within the range 5 $\mu$m $<d_p<$1000 $\mu$m) when the following are valid for the system:

density of the wax, $\rho_l$=0.7 g/cm$^3$, viscosity of the wax, $\mu$=0.005 gr/cm/sec, density of the catalyst particles, $\rho_s$=1.9 g/cm$^3$.

FIG. 2 also shows the corresponding value of $Re_p$; as can be observed, for particles with an average diameter higher than 38 $\mu$m, the Reynolds' number $Re_p$ is greater than 0.1 and $U_t$ is determined by means of the Eq. (E.5).

EXAMPLE 4

Determination of the Function $f(C_p)$

The function $f(C_p)$, which represents the hindering effect of the concentration of the solid on the settling velocity, can generally be described as:

$$f(C_p)=(1-C_p)^n \quad \text{(E.6)}$$

and is practically equal to 1 for very dilute slurry (liquid-solid) systems ($C_p\rightarrow 0$), whereas it monotonically decreases with an increase in $C_p$, until it tends towards values close to 0 for very concentrated slurry systems (maximum packing).

The exponent n of the Eq. (E. 6) depends on the Reynolds' particle number (Perry's):

n=4.65 for $Re_p<0.3$, whereas n=2.33 for $Re_p>1000$.

In the intermediate region n is a decreasing function of $Re_p$. From the graph indicated in Perry's, it is possible to approach the exponent n by means of the following correlation:

$$n=4.1721\cdot Re_p^{-0.0658} \quad \text{(E.7)}$$

EXAMPLE 5

Determination of the Dispersion Coefficient of the Solid

The dispersion coefficient of the solid, $D_{ax,s}$, along the axial co-ordinate of the three-phase column reactor is a parameter which is difficult to determine. Correlations in literature (L.S. Fan, Gas-Liquid-Solid Fluidisation Engineering, 1989) prevalently refer to air-water-quartz systems ($\rho_s$=2.5 g/cm$^3$) with diluted concentrations of solid in small-sized columns and without internal devices (such as for example a tube-bundle heat exchanger), which may influence the mixing degree of the phases present in the column.

As it is necessary, when planning a slurry bubble column reactor, to estimate the $D_{ax,s}$ coefficient before constructing the column, some assumptions have to be taken, in order to identify one (or more) correlation capable of predicting $D_{ax,s}$ with close approximation:

1. Operating the column with gas flow-rates which are such as to establish under heterogeneous or churn-turbulent flow conditions (presence of a wide distribution of the gas bubble dimensions in the column ranging from about 3 to about 80 mm), the mixing effect prevalently derives from the fraction of gas which runs through the column in the form of large bubbles (20–80 mm), and which drags in its upward movement, at a rate in the order of 1–2 m/s, both the liquid and the solid suspended in the liquid. The gas therefore causes macro-vortexes of the continuous phase (the liquid) in which the solid is suspended, increasing the mixing degree, with respect to when a homogeneous flow regime is used (low gas flow-rates, gas bubbles uniformly distributed and with small dimensions, 3–6 mm). In the turbulent flow regime it is possible to compare the mixing degree of the solid phase with the mixing degree of the liquid phase: $D_{ax,s}\equiv D_{ax,L}$ (Kato et al., from L.S. Fan, Gas-Liquid-Solid Fluidisation Engineering, 1989).
2. Correlations in literature which describe $D_{ax,L}$ generally show a dependence on the superficial gas velocity, $U_g$, proportional to the exponent 0.3–0.5, and a dependency on the diameter of the column, $D_c$, proportional to the exponent 1.25–1.5, at least for columns of up to 1 m in diameter (Fan, Gas-Liquid-Solid Fluidisation Engineering, 1989): $D_{ax,L}\ U_g^{0.3\div0.5}.D_c^{1.25\div1.5}$. With an increase in the diameter of the column, one can presume that the effect of $D_c$ on $D_{ax,L}$ decreases. It is recommendable to substitute a linear correlation of $D_c$ when operating with columns having a diameter of more than one meter: $D_{ax,L}\ U_g^{0.3\div0.5}.D_c$. For example, if we wish to use the Baird & Rice correlation (Fan, 1989) : $D_{ax,L}=0.35.\ (g.U_g)^{1/3}.D_c^{3/4}$, for column diameters greater than 1, it is preferable to modify the above correlation as follows: $D_{ax,L}=0.35.\ (g.U_g)^{1/3}.D_c$, to be more conservative on the effect of the column diameter in the mixing degree of the liquid-solid suspension. The Baird & Rice correlation is expressed in SI units.

EXAMPLE 6

Determination of the Concentration Profile of the Solid

The concentration profile of the solid is estimated by means of the dispersion-sedimentation model, which under steady-state conditions is:

$$\frac{d}{dx}\left(\frac{1}{Pe_s}\cdot\frac{dC_p}{dx}\right)+\frac{d}{dx}[(U_s-U_L)\cdot C_p]=0 \quad \text{(E.8)}$$

wherein x=adimensional axial co-ordinate, $Pe_s$=Peclet number of the solid, defined as $Pe_s=U_g.H/D_{ax,s}$.

The analytical solution of the Eq. (E.8) is the following:

$$C_p(x)=\overline{C}_p Bo_s\cdot\frac{\exp(-Bo_s\cdot x)}{1-\exp(-Bo_s)} \quad \text{(E.9)}$$

wherein $Bo_s$=Bodenstein number, defined as $Bo_s=Pe_s.\ (U_s-U_L)/U_g=(U_S-U_L).H/D_{ax,s}$.

Figure 3:
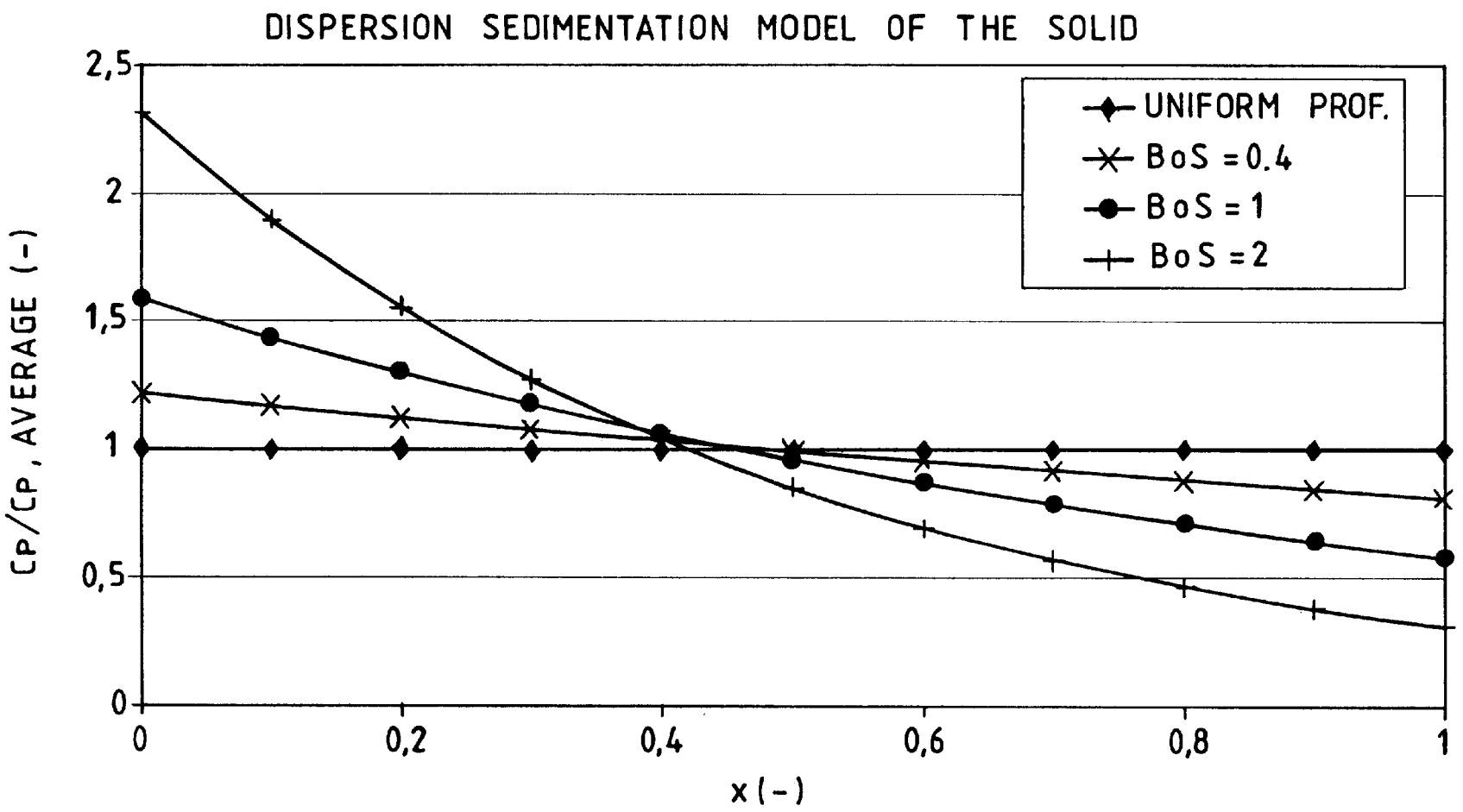
FIG. 3 represents the normalized axial concentration profile of the solid ($C_p(x)/\overline{C}_p$) for various values of the $Bo_s$ parameter, precisely 0.4, 1 and 2.

FIG. 3 shows the normalized concentration profile ($C_p(x)/\overline{C}_p$) for various values of the $Bo_s$ parameter.

As can be observed from FIG. 3, when $Bo_s$ tends towards zero the concentration profile becomes homogeneous. To ensure a concentration profile of the solid which is such that $C_p$ (x) varies by ±20% $\overline{C}_p$ the column must operate under such conditions that $Bo_s<0.4$.

EXAMPLE 7

Effect of the Geometry of the Bubble Column Reactor on the Dispersion Degree of the Solid Phase It is known that with an increase in the diameter of the column, $D_c$, and gas surface rate, $U_g$, the mixing degree of both the liquid phase and solid phase increases. In order to have a sufficient dispersion degree of the solid inside the triphasic bubble column reactor, for example by estimating a maximum variation in the concentration of the solid in the column equal ± to 20% of the average concentration of the solid, the following constraint has to be respected:

$$Bo_s = \frac{(U_s - U_L)\cdot H}{D_{ax.S}} \leq 0.4 \qquad \text{(E.10)}$$

If the constraint (E.10) is satisfied when the liquid is batch ($U_L=0$), it will be even more so when $U_L\neq 0$. In order to be more conservative, the Eq. (E.10) is thus modified as follows:

$$Bo_s = \frac{U_s\cdot H}{D_{ax.S}} \leq 0.4 \qquad \text{(E.11)}$$

The constraint described by (E.11) depends on the height of the dispersion (gas-liquid-solid), H, the diameter of the column and gas surface rate (of which $D_{ax,s}$ is a function), as well as the properties of the system, such as density, dimension and concentration of the solid particles (of which $U_s$ is a function)

It is therefore possible to study what the minimum column diameter is to satisfy the constraint (E.11) with variations in the height of the dispersion and superficial gas velocity, depending on the type and concentration of the catalyst.

By substituting for example in Eq. (E.11) the Baird & Rice correlation to determine $D_{ax,s}$, and suitably $$D_c^{4/3} \geq \frac{2.5\cdot U_g\cdot H}{0.35\cdot(g\cdot U_g)^{1/3}}$$

re-arranging the formula:

$$\text{for } D_c \leqq 1 \text{ m} \qquad \text{(E.12)}$$

$$D_c \geq \frac{2.5\cdot U_g\cdot H}{0.35\cdot(g\cdot U_g)^{1/3}} \quad \text{for } D_c > 1 \text{ m} \qquad \text{(E.13)}$$

are obtained.

Once H, $U_g$, and $C_p$ have been established to have a certain space velocity (GHSV=$U_g$/H) and a certain conversion of the gaseous reagents (which depends on the specific activity of the catalyst selected and on the reaction conditions such as temperature and pressure), by means of the Eq. (E.12) and the Eq. (E.13), it is possible to determine the minimum value of the column diameter, while changing $d_p$ and the particle density $\rho_p$, in order to satisfy the constraint (E.11). The settling velocity of the solid, $U_s$, is given by the equation:

$$U_s=U_t\cdot f(C_p)$$

Wherein $U_t$ and $f(C_p)$ were defined in examples 3 and 4 respectively.

Figure 4:
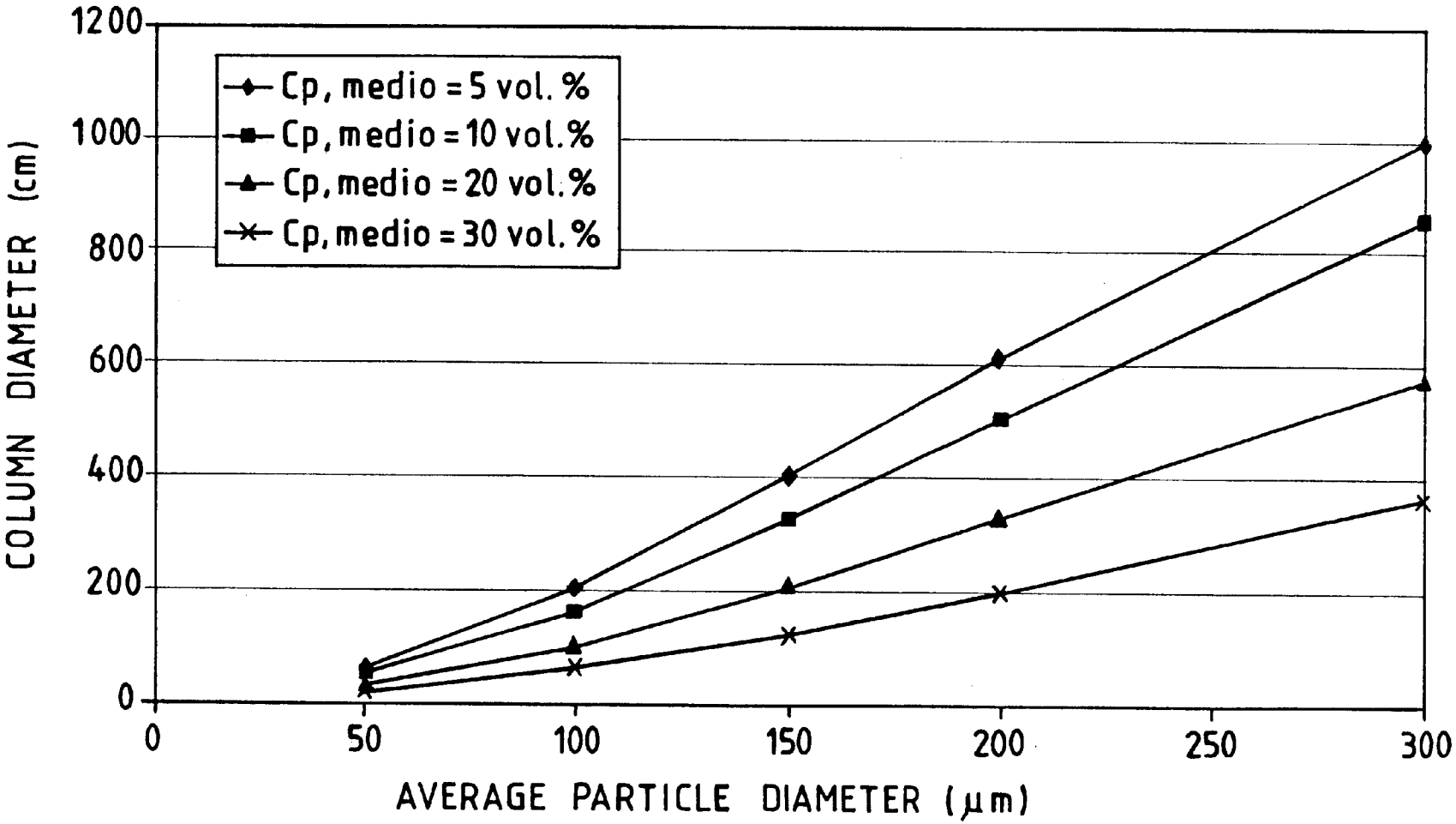
FIG. 4 indicates the trend of the column diameter as a function of the average particle diameter with variations in the average concentration of solid in the column to satisfy the requirement of example 7.

FIG. 4 indicates the example relating to the following system:

dispersion height (gas-liquid-solid), H=30 m;

gas surface rate at reactor inlet, $U_g$,=0.08 m/s liquid density (wax), $\rho_l$=0.7 g/cm$^3$, liquid viscosity (wax), $\mu$=0.5 cP, particle density, $\rho_s$=1.9 g/cm$^3$.

The curves, parametric in the average volumetric concentration of the solid, $\overline{C}_p$ (or $C_{p,average}$), indicate the minimum column diameter to satisfy the constraint (E.11) as a function of the average particle diameter.

The volumetric concentration of the solid varies from 5 to 30% v/v.

As can be observed in FIG. 4, the increase in $d_p$ causes an increase in the minimum column diameter thus satisfying the constraint (E.11), whereas by increasing the concentration of the solid in the column, $C_p$, the minimum value of $D_c$ decreases.

Curves analogous to those of FIG. 4 can be drawn for different particle densities, varying H and $U_g$. The selection of $U_g$=0.08 m/s made in this example, refers to a minimum gas rate for having a completely developed churn-turbulent flow regime. By increasing the gas rate, the dispersion of the solid increases, and therefore the minimum diameter for verifying the constraint (E.11) is reduced; the same thing occurs when the dispersion height is reduced.

In the design of an industrial reactor, assuming the following conditions:

dispersion height (gas-liquid-solid), H=30 m;

gas surface rate at the reactor inlet, $U_g$=0.08 m/s, liquid density (wax), ), $\rho_l$=0.7 g/cm$^3$, liquid viscosity (wax), $\mu$=0.5 cP, particle density, $\rho_s$=1.9 g/cm$^3$ average concentration of the solid, $\overline{C}_p$=20% v/v, to obtain a definite reagents conversion and productivity to hydrocarbons, and wishing to operate with particles which are sufficiently large to allow easy separation, but sufficiently small to minimize the diffusive intraparticle effect, for example $d_p$=200 $\mu$m, the minimum diameter of the reactor should be estimated for respecting the limit (E.11), i.e. for obtaining an excellent concentration profile distribution in the column.

From the values indicated in FIG. 4, the result is therefore that $D_c$ must be greater than or equal to 330 cm.

For example, in the case of a 5 m diameter commercial reactor, the relative $Bo_s$ value is equal to 0.26<0.4, the constraint (E.11) is thus respected and the concentration profile of the solid, expressed by the Eq. (E.9) proves to be within the range of ±13% of the average concentration of the solid, $\overline{C}_p$, which in this example is equal to 20% v/v.

This example shows that even when operating with particles having larger dimensions, wherein Stokes' equation is no longer valid ($Re_p$8.9>>0.1), it is possible to obtain a good dispersion in the solid phase, by suitably dimensioning the reactor.

EXAMPLE 8

Effect of the Catalyst Particle Dimension on the Liquid-solid Separation.

It is known that with an increase in the particle diameter, it is easier and less expensive to separate a solid from a liquid.

Figure 5:
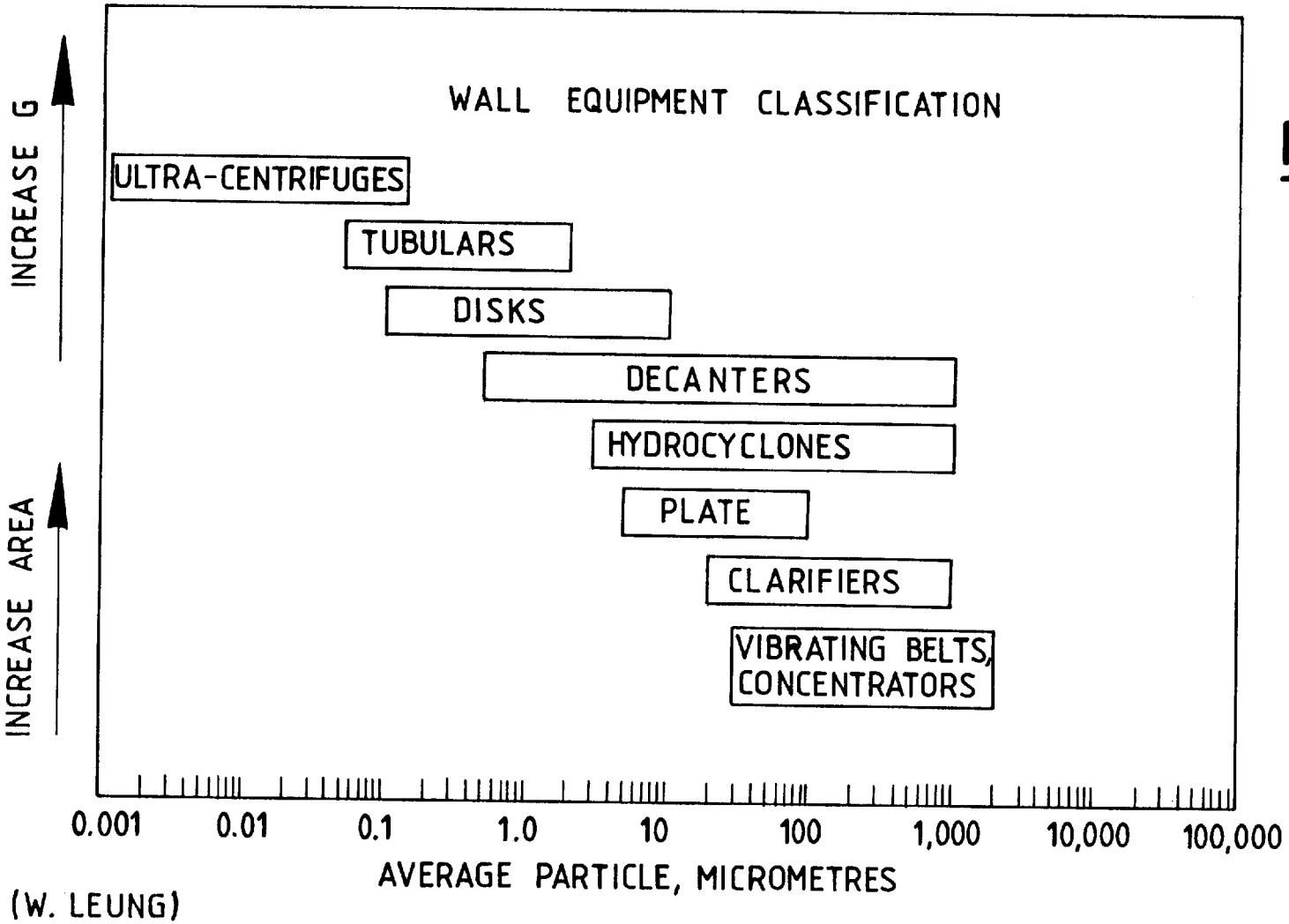
FIG. 5 shows a classification of the solid-liquid separation equipment, of the wall solid type, as a function of the particle size.

FIG. 5 (taken from W. Leung, Industrial Centrifugation Technology, McGraw-Hill Inc., March 1998), shows a classification of solid-liquid separation equipment, of the solid wall type, as a function of the particle size. The equipment is classified according to two different functioning principles: for dynamic decanting (in which the acceleration induced on the particles is important) and for static decanting (in which the surface characteristic of the decanter is important) From FIG. 5 it can be observed that, with an increase in the particle dimension, the gravitational acceleration required (G number) or surface desired, respectively decrease. Reducing the G number means decreasing the rotation rate, and therefore saving energy. Reducing the surface means reducing the size of the equipment.

Figure 6:
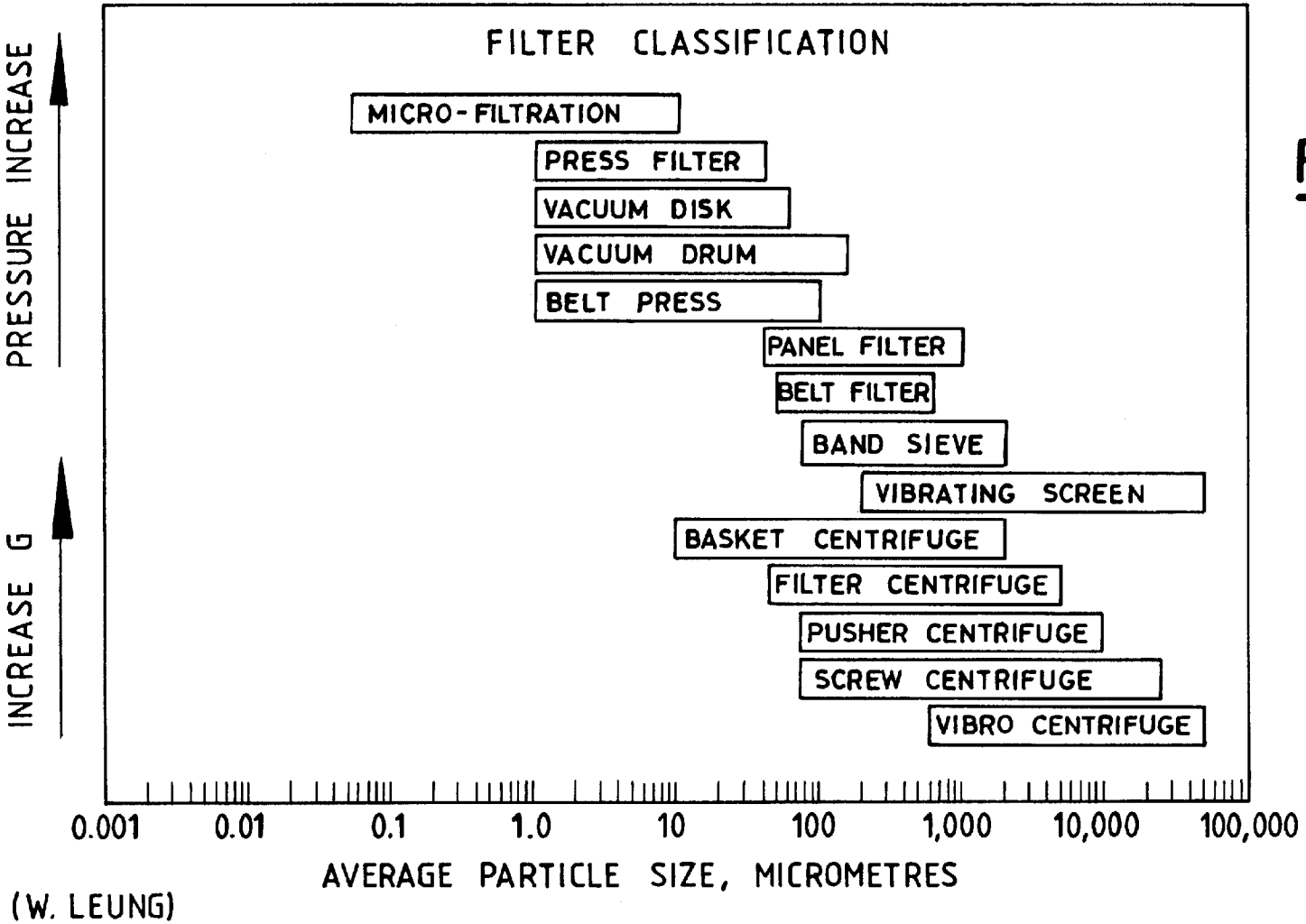
FIG. 6 shows a classification of the solid-liquid separation equipment, of the filtration type, as a function of the particle size.

FIG. 6 (taken from W. Leung, Industrial Centrifugation Technology, McGraw-Hill Inc., March 1998) shows a classification of solid-liquid separation equipment, of the filtration type, as a function of the particle size. The equipment is classified according to two different functioning principles: for filtration under pressure (in which the difference in pressure exerted between upstream and downstream of the filter, is important) and for filtrating centrifugation (in which the acceleration induced on the particles is important). It can be observed from FIG. 6 that, with an increase in the particle size, the pressure or gravitational acceleration required (G number), respectively decrease. Reducing the pressure, or G number, means reducing the work required and therefore saving energy.

Figure 7:
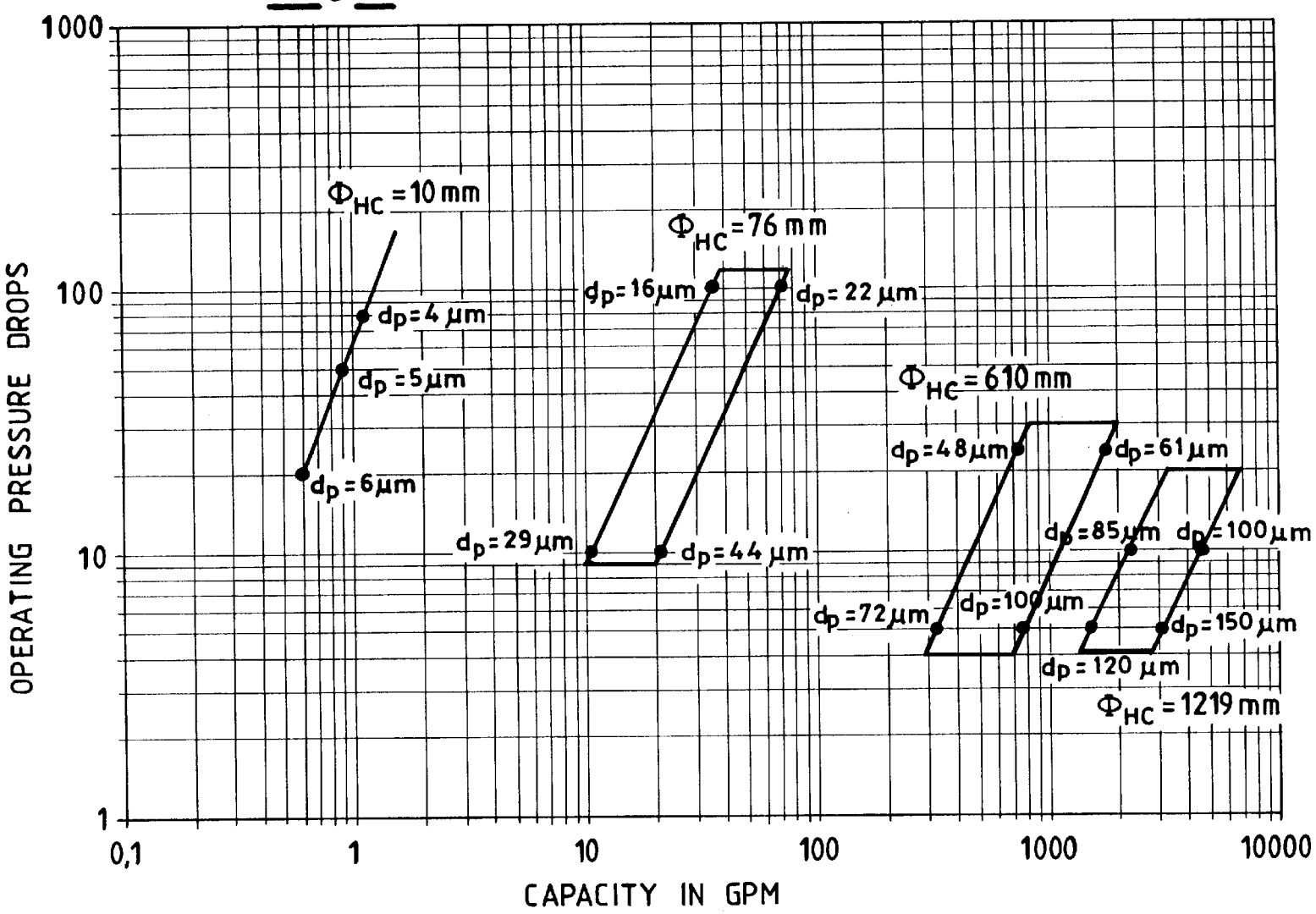
FIG. 7 indicates the utilization fields of commercial hydrocyclones having various dimensions in relation to the GPM (gallons per minute) capacity, of the operating pressure loss and particle dimension.

FIG. 7 (taken from the commercial publication under the care of Dorr-Oliver, The DorrClone Hydrocyclone, Bulletin DC-2, 1989) shows the utilization fields of commercial hydrocyclones of various sizes as a function of the GPM capacity, operating pressure loss and particle size.

A hydrocyclone is a static apparatus which exploits the difference in density between solid and liquid and the centrifugal power induced, for separating the solid particles from the fluid in which they are suspended. For example, assuming a capacity of 680 $m^3/h$ of liquid-solid suspension to be treated, equal to about 3000 GPM (specific gravity of the solid 2.7, concentration of the solid of 25% by weight, and separation efficiency of 95%), it can be observed that increasing the granulometry of the solid particles, it is possible to use a smaller number of hydrocyclones, but with a larger diameter, according to the following table:

| Particle Diameter | Diameter hydrocyc. | Total capacity/ Single hydrocycl. Capacity | Number hydrocycl. required | Pressure drop (psig) |
|---|---|---|---|---|
| 5 $\mu$m | 10 mm | 3000/0.9 | 3333 | 40 |
| 44 $\mu$m | 3 inch. (76 mm) | 3000/20 | 150 | 10 |
| 100 $\mu$m | 24 inch. (610 mm) | 3000/700 | 4 | 5 |
| 150 $\mu$m | 48 inch. (1219 mm) | 3000/3000 | 1 | 5 |

It can be clearly seen from the above table that passing from solid particles of 5 $\mu$m to particles of 150 $\mu$m the number of hydrocyclones passes from 3000 to 1. This allows an enormous cost reduction for two reasons: the first is that the number of hydrocyclones required is reduced, the second is that the constructive difficulty, which increases with a decrease in the diameter of the hydrocyclone, is reduced.

Considerations on the Above Examples

The objective of the examples described above was to demonstrate that:

by operating within the validity regime of Stokes' law, i.e. $Re_p<0.1$ (as disclosed by patent Exxon EP' 860), it is necessary to limit the average diameter of the particles with which the slurry reactor operates.

The Reynolds' particle number, $Re_p$, depends on the properties of the system and density of the solid, therefore the limit of $d_p$ to enable Stokes' law to be valid, also depends on the properties of the system.

As it is preferable to operate with solid particles having a larger average diameter (compatible with a negligible decrease in the efficiency of the catalyst), for example 100–200 $\mu$m, in order to favour the liquid/solid separation unit, it is no longer possible to operate within the validity regime of Stokes' law. To determine the settling velocity of the particle, it is necessary to use correlations different from Stokes' law as described in the above examples.

Increasing the dimensions of solid particles means increasing the settling velocity of the solid with all the other parameters of the systems remaining unchanged. In order to have an optimum distribution of the solid inside the bubble column reactor, it is preferable to size the reactor (and in particular the diameter of the column) to be such as to respect the $Bo_s$ limit$\leqq 1$, preferably $Bo_s<0.4$.

For a reactor of a commercial size and a system representative of the Fischer-Tropsch synthesis reaction, the value of $Bo_s$ is less than 0.4, i.e. there is an optimum dispersion of the solid phase even when operating with particle diameters which are such that $Re_p>>0.1$ (outside the validity limits of Stokes' law), at the same time favouring the liquid-solid separation. With an increase, in fact, of the particle diameter, the volume required by the separation step decreases, and also the constructive difficulty, with the same concentration of solid.

The examples also describe a possible approach for estimating "a priori" the axial dispersion coefficient of the solid, $D_{ax,s}$,for a gas-liquid-solid fluidized reactor of a commercial size (diameter>1 m).

What is claimed is:

1. A process for optimizing the production of heavy hydrocarbons according to the Fischer-Tropsch process and separation of the hydrocarbons produced, starting from mixtures of reagent gases, essentially consisting of CO and $H_2$, optionally diluted with $CO_2$, in the presence of supported catalysts, which comprises:

(a) feeding the reagent gases into a reactor at flow rates which establish heterogeneous or chum-turbulent flow conditions in the reactor, thereby maintaining a dispersion of the solid in the liquid phase, in this manner at least partially transforming the reagent gases into heavy hydrocarbons; and (b) at least partially recovering the heavy hydrocarbons formed in step (a) by external or internal separation of the heavy hydrocarbons from the catalyst particles; wherein, in reaction step (a) the reaction takes place:

(1) in the presence of solid particles which have a Reynolds' number ($Re_p$) greater than 0.1, wherein $$Re_p = \frac{d_p \cdot v \cdot \rho 1}{\mu},$$

wherein $d_p$ is the average particle diameter, v is the relative velocity between particle and liquid, $\rho_1$ is the density of the liquid, and $\mu$ is the viscosity of the liquid; and (2) maintaining the solid particles suspended at a height H in the reactor so as to establish a Bodenstein number $Bo_s \leqq 1$, which is determined by the relationship $Pe_s(U_s-U_1)/U_g$, wherein $Pe_s$ is the Peclet number of the solid, $U_s$ is the sedimentation rate of the solid, $U_1$ is the circulation velocity of the liquid phase and $U_g$ is the superficial gas velocity.

2. The process according to claim 1, wherein the reagent gases are introduced into the reactor from its bottom.

3. The process according to claim 1, wherein $Re_p$ ranges from 0.11 to 50.

4. The process according to claim 3, wherein $Re_p$ ranges from 0.2 to 25.

5. The process according to claim 1 wherein $Bo_s$ is $\leqq 0.4$.

6. The process according to claim 1, wherein the solid catalyst particles consist of cobalt supported on alumina.

7. The process according to claim 1, wherein the support of the catalyst has a surface area ranging from 20–300 $m^2/g$.

8. The process according to claim 7, wherein said surface area ranges from 50–200 $m^2/g$.

* * * * *